United States Patent [19]

Ostberg

[11] 4,240,618

[45] Dec. 23, 1980

[54] STIRRER FOR METALLURGICAL MELTS

[76] Inventor: Jan-Erik Ostberg, Torps Sateri, Bettna, Sweden, 640 33

[21] Appl. No.: 14,332

[22] Filed: Feb. 23, 1979

Related U.S. Application Data

[63] Continuation of Ser. No. 966,942, Dec. 4, 1978, which is a continuation of Ser. No. 817,727, Jul. 21, 1977, abandoned.

[51] Int. Cl.[3] ..... C21C 7/00

[52] U.S. Cl. ..... 266/235

[58] Field of Search ..... 266/235

[56] References Cited

U.S. PATENT DOCUMENTS

| | | | |
|---|---|---|---|
| 2,488,447 | 11/1949 | Tangen | 266/235 |
| 2,780,541 | 2/1957 | Zifferer | 75/93 R |
| 2,786,755 | 3/1957 | Paddock | 75/93 R |
| 3,063,828 | 11/1962 | Booth | 75/93 R |
| 3,278,295 | 10/1966 | Ostberg | 75/93 R |
| 3,792,848 | 2/1974 | Ostberg | 266/235 |
| 3,802,872 | 4/1974 | Ostberg | 75/93 R |

*Primary Examiner*—P. D. Rosenberg
*Attorney, Agent, or Firm*—Robert D. Yeager; Olin E. Williams

[57] ABSTRACT

A vertically symmetrical mechanical stirrer adapted for submersion in a metallurgical melt includes an entrance canal in the bottom of the stirrer and at least two discharge canals in communication with the entrance canal. The community or common zone of the entrance canal and the discharge canals defines an inner mixing and degassing chamber. The entrance canal has a length which is not more than twice its inner diameter; the discharge canals have a length at least twice their average inner diameter and inner diameter of which uniformly diminish in the direction of flow from the mixing chamber to the point of discharge. The discharge canals are inclined upwardly at an angle from the horizontal of at least 10°. The distance between the lowest points at the entrances to the discharge canals proximate to the mixing chamber is at least 20 percent greater than the inner diameter of the entrance canal.

The exterior surfaces of the stirrer constituting a vertically symmetrical upper surface above the discharge points of the said discharge canals, and a lower surface, also vertically symmetrical, below the said points, are effectively congruent with annular torus eddies formed in the melt by the stirrer.

10 Claims, 3 Drawing Figures

STIRRER FOR METALLURGICAL MELTS

CROSS REFERENCE TO RELATED APPLICATIONS

This application is a continuation of U.S. Ser. No. 966,942, filed Dec. 4, 1978, which is a continuation of U.S. Ser. No. 817,727, filed July 21, 1977, now abandoned.

BACKGROUND OF THE INVENTION

1. Field of the Invention

This invention relates to stirrers for metallurgical melts and more particularly to mechanical stirrers for metallurgical melts.

2. Description of the Prior Art

In metallurgical melts it is desirable to obtain a homogenous mixture of the various reaction constituents to provide a consistent high quality product. To obtain the desired homogenity various means of agitation have been considered which aid in the intermixing of reaction constituents. Among these agitation means are mechanical stirrers which when rotated provide a pumping action thus agitating the melt. An early apparatus to accomplish the pumping action within the melt has a vertical pipe, open at the top and closed at its bottom with horizontal open pipes connected to the vertical pipe. The horizontal pipe openings are in communication with the inner opening of the vertical pipe. This apparatus was rotated at high speed and additions of solid material were made to the melt through the vertical pipe's top opening.

Advances in metallurgy, especially ferrous metallurgy, have combined to subject metallurgical melts, to which solid, liquid, or gaseous additions may be made, to rapid reactions of various kinds and to severe restrictions in analysis and resultant characteristics of final product and have created an increased need for improved mixing and treating means. Even though, for example, the hot metal or molten steel from an open hearth or basic-oxygen furnace has been refined to a degree generally experienced in only recent years, further refining can be accomplished by the addition of agents to the molten metal. A brief opportunity for such treatment is provided in the hot metal ladle, to the contents of which refining elements can be added, either to the surface or by means of stirrers or mixers into the interior thereof.

The stirrer of the present invention meets this need for rapid and effective refining of hot metal; the need is further demonstrated by the number of prior art efforts, exemplified by the following items of prior art, that sought unsuccessfully or inadequately to meet such a need.

The centrifugal pumping action obtainable by rotating a body having a fluid inlet near its axis and connecting channels to its periphery has long been known as shown, for example, in MacNeille U.S. Pat. No. 1,986,836, issued Jan. 8, 1935. In Heuer U.S. Pat. No. 2,290,961, issued July 28, 1942 such a rotating body with axial inlet and ascending connecting channels is employed as the impeller of desulphurizing apparatus for the treatment of molten iron; but the shape of the impeller especially in respect of the upper surface above the channel exits is substantially that of a paddle. Rotation of this paddle will create a vortex and cause the slag phase on the surface of the melt to be pushed to the edges of the vessel impairing the function of these agents. In addition the paddle effect will soon impel the entire body of the melt to circulate in the vortex thus minimizing the mixing of agents within the melt. Another early form of stirrer appeared in the "Foundry Trade Journal" of Feb. 25, 1940. The apparatus therein shown did, owing to its exterior surfaces, exert a lot of friction upon the melt and as a consequence produces and unfavorable pressure-pattern in the melt, and it furthermore makes no provision for exchange of material between eddies in the melt.

In Sundstrom et al. U.S. Pat. No. 2,525,973, issued Oct. 17, 1950 the feeding of a treating agent into and beneath the surface of molten iron contemplates such addition to the pig-iron runner and further exemplifies the technological demand to add refining agents to molten metal and in rapid intimate mixture therewith. Another feeding apparatus is that of Clenny et al. U.S. Pat. No. 285,812, issued Oct. 28, 1958 which employs gas under pressure to feed refining agents into and beneath the surface of molten metal. Neither of the devices provides means for maintaining thorough mixing of the agents with the molten metal.

Ostberg et al. U.S. Pat. No. 3,278,295, issued Oct. 11, 1966 discloses and claims a method of stirring a metal with a vertical-pipe device which demonstrates again the paddle effect of excessive melt rotation. Exemplary of such a stirrer is also German patent No. 1,190,479. The Ostberg et al. patent claims only a path of movement in a greater portion of the charge and an additional path through an elongated vertical feed pipe and lateral pipes of at least 15 percent of the sum of the height and diameter of the charge. Such an elongated pipe would interfere, as hereinafter shown, with unexpected improvements of the subject matter of invention, and was thought to be necessary when stirring effects in the bath were imperfectly understood. Another apparatus of which the impeller, here adapted for feed of agents into the molten steel, is essentially a paddle on the end of a pipe is that disclosed in Japanese patent No. 47-51681 which issued Mar. 3, 1969. Inert gas is fed in with the agents to give some agitating (mixing) action to the molten steel, but otherwise the stirring provided effects only the usual vortical movement above the central axis.

A Russian patent, No. 280,505, issued Dec. 8, 1970 displays a mixer, having a long vertical "collector tube" similar to that of the aforementioned Ostberg et al. which mixer acts as a centrifugal pump to move hot metal out of side vents onto the slag bed of hot metal in the ladle. The Russian apparatus effects thus a different purpose, and in fact, were it sufficiently immersed to act on the surrounding metal, having a flat top configuration, would have the usual paddle effect.

Ostberg U.S. Pat. No. 3,573,895 issued Apr. 6, 1971, introduces gas at the junction point of the vertical pipe shaft and lateral arms to bring up flowing hot metal into contact with the slag layer on a body of hot metal, and neither contemplates nor provides for mixing of agents in the said body of metal.

Polomsky, Canadian Patent No. 871,006, which issued May 18, 1971 to Demag, A. G. discloses another method where extreme metallurgical results are aimed at by injecting agents into the molten metal in a vessel such as hot metal ladle. This patent expressly notes that the device employed induces a circulatory flow in the metal, and, in fact, the apparatus with its sidearms laterally protruding is operated fully submerged in the melt where the sidearms force the surrounding melt to co-rotate almost synchronously. This not only requires much power but also because of the shape of the sidearms causes splashing; and, in addition the substantially synchronous rotation of the melt with the rotation of the arms makes homogenization of the injected material too slow.

The metallurgy associated with the treatment of steel melts, the role of the basic slag layer, and the chemistry of additives injected into the melt are described at length in Richter et al. U.S. Pat. No. 3,885,957 issued May 27, 1975 in which also is taught the critical value of the depth of addition of the additives under the given circumstances, i.e., over 2000 mm. below the surface of the melt. In Richter et al. no special provision is made for improving the mixing of the additives.

Furck et al., U.S. Pat. No. 3,887,172, issued June 3, 1975 and discloses the treatment of molten metals in a casting ladle by introducing gas in a rising column of molten metal in a vertically entered conduit; while the claimed apparatus effects no mechanical pumping action at all, the patent clearly describes, under Background of the Invention, the techniques that had theretofore been applied for such metal treatment and the numerous difficulties, e.g. disruption of the slag layer, that had been encountered with known mechanical devices.

A disadvantage created by a surface vortex on the surface of stirred molten metal that is in addition to disturbing the layer of reaction slag is described in Downing et al. U.S. Pat. No. 4,063,932 which issued Dec. 20, 1977. This patent, however, shows only a simple stirrer without means for mechanically pumping molten metal or additives into the melt.

The foregoing references demonstrate the efforts expended by industry for several decades to accomplish rapid and efficient mixing of additives such as desulfurizing or alloying agents, many of which incidentally, are of low specific gravity, into molten metal, especially molten steel.

In accordance with the present invention a mechanical stirrer for metallurgical melts now is provided which is designed for maximum mixing efficiency through pumping, is adapted for the introduction of fine grained material into the melt, and adapted for collecting liberated gas. The liberated gas is not only collected by the apparatus, as when gas is produced by the reaction of additives with the melt, but the apparatus also provides for a zone of low pressure within the melt whereby a degassing of the melt is obtained.

Further advantages provided by the invention will be apparent from the following description thereof by way of the following drawings in which like elements are identified by like reference numerals.

DEFINITIONS

Figure 1:
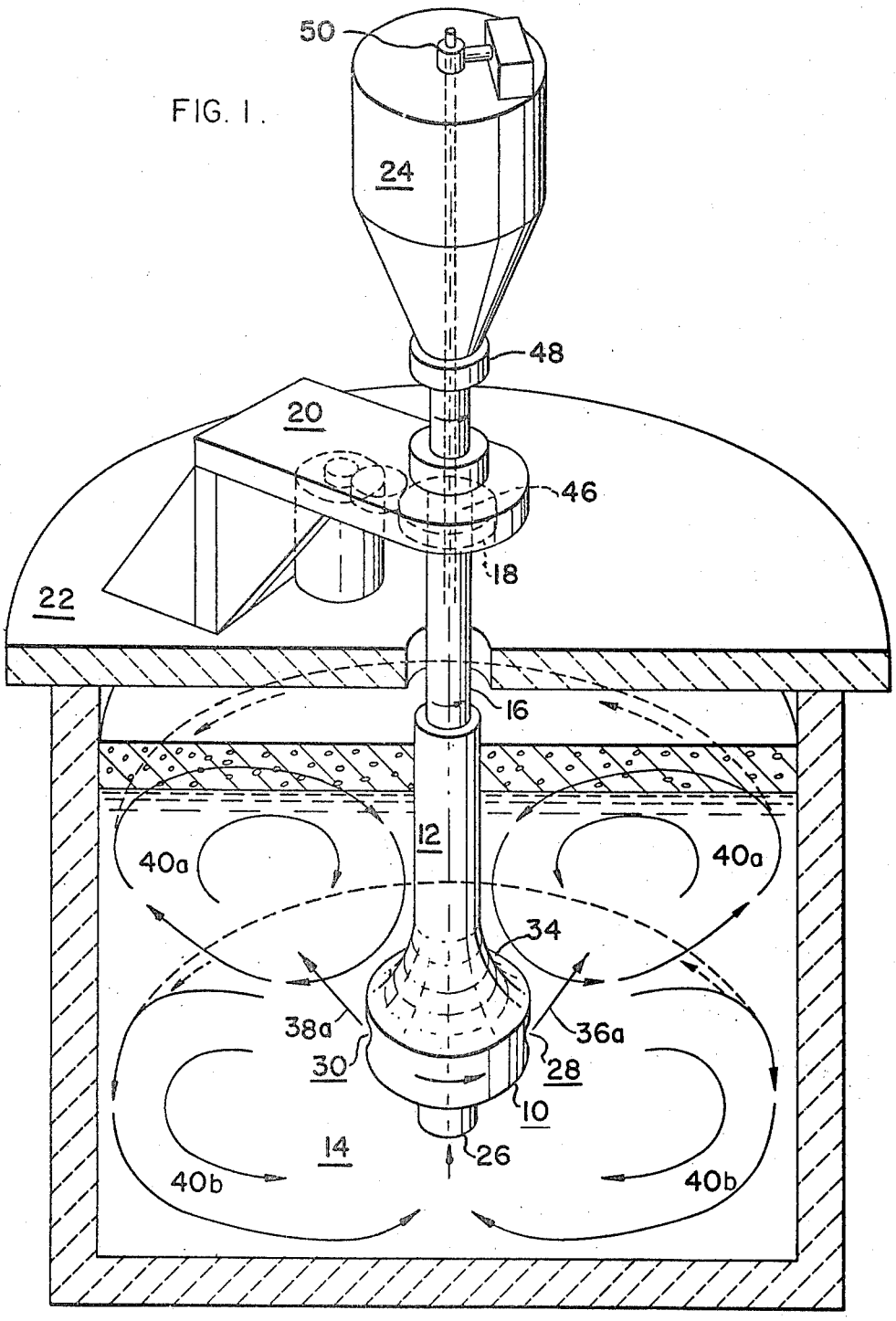
FIG. 1 is a perspective view partially in phantom showing a stirrer in accordance with the invention in operation.
Figure 2:
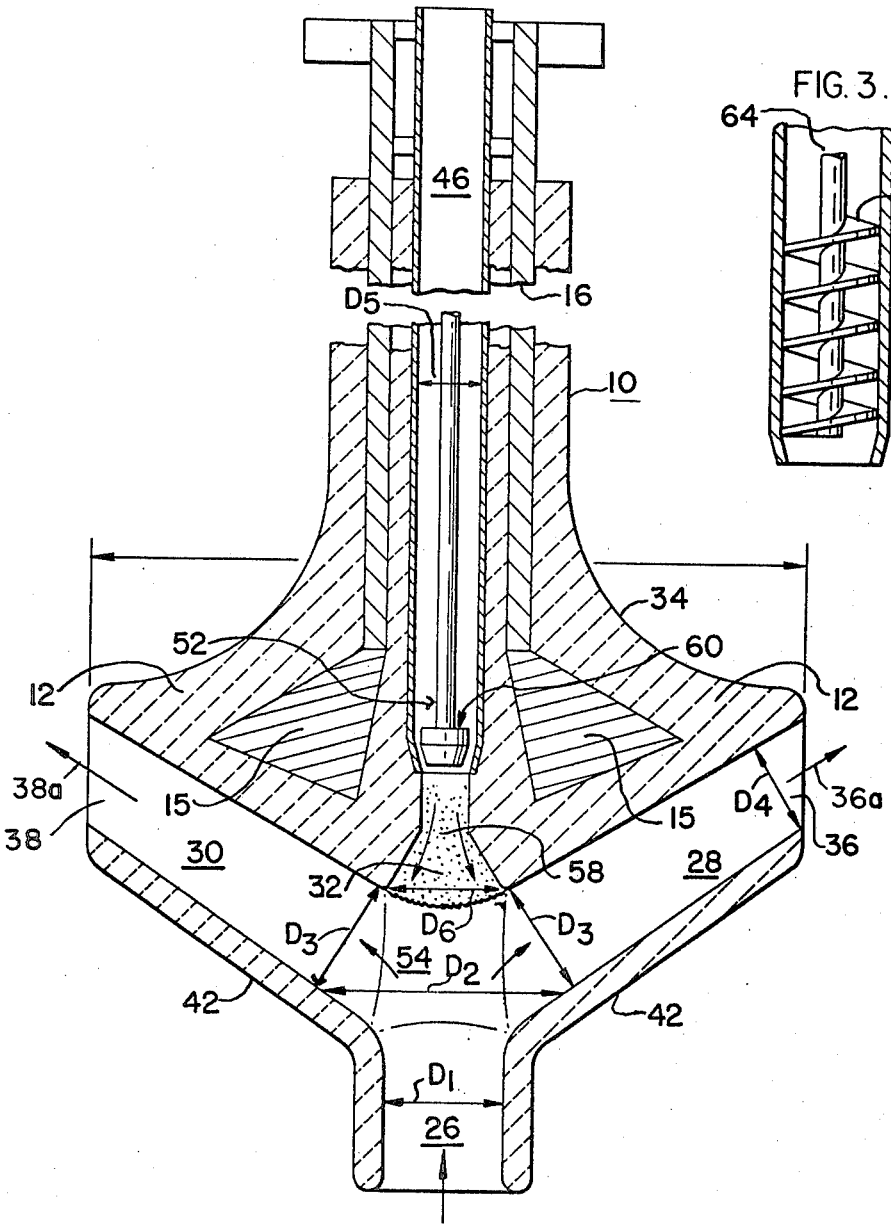
FIG. 2 is a cross-sectional view of the stirrer of FIG. 1.

An examination of FIGS. 1 and 2 and especially of the torus eddies shown at 40 in FIG. 1 and the stirrer exterior surfaces shown at 34 and 42 in the said Figures will demonstrate that the said exterior surfaces, which are roughly frusto-conical in shape, conform effectively to the continguous surfaces of the torus eddies ("torus" itself being defined in Webster's New Collegiate Dictionary, of Gaud C. Merriam Company of Springfield, Mass. U.S.A., Copyright 1973 at page 1233, No. 4; as, a doughnut-shaped surface generated by a circle rotated about an axis in its plane that does not intersect the circle; and "eddy" being defined in the same dictionary on page 361, at 1(a) as "a current of water or air running contrary to the main current; esp. a small whirlpool;" and at 1(b) as something (here molten steel) moving similarly.). The said upper and lower continguous stirrer exterior surfaces hereafter in specification and claims termed "torus conforming surfaces" are thus defined as substantially curvilinear (effectively but not totally or literally limited thereto) bell-shaped surfaces, the upper and lower surfaces extending outwardly toward each other (the lower surface being inverted bell-shaped) and being free of any rectilinear or extensive horizontal shapes such as will interfere with torus eddy formation and maintenance.

The area $D_3$ at the entrance of each converging discharge canal 28 and 30 as shown in FIG. 2 is termed in the specification and claims "discharge-canal entrance" and is defined as the cross section of the base of the discharge canal at the initial point of flow of molten steel in the discharge canal, the said initial point of flow being in turn that point at which the inner surface of the canal regularly along the longitudinal axis of the canal begins uniformly to converge thus forming a hollow tube of frusto conical conformation (except at its exit where one side of the tube is extended to meet the exit) with the base of the hollow tube forming the defined entrance.

DETAILED DESCRIPTION OF THE DRAWINGS

Referring now to FIGS. 1 and 2, the stirrer 10 is comprised of symmetrical body with a refractory exterior 12 adapted for submersion into the melt 14 the upper portion of which body has a torus conforming surface 34. A hollow drive shaft 16 is rotated by motor and gear assembly 18 with the stirrer being supported by support 20 mounted on cover plate 22. A structural member 15, which may be solid as is shown in FIG. 2, is preferred for small stirrers, whereas a cooled plate box is preferred for larger stirrers. The hollow drive shaft 16 allows for addition of materials to the melt 14. The hollow drive shaft 16 is in communication with hopper 24 which holds additional material preferably in granulated form. The stirrer body 10 has an entrance canal 26 which communicates with discharge pumping canals 28 and 30. The community of the discharge and entrance canals forms a mixing chamber with a base diameter $D_2$. The discharge and entrance canals are generally cylindrical on the interior thereof. The discharge opening of the addition canal 32 is conical for efficient discharge of material to be added. The torus conforming surface 34 of the stirrer 10 is shaped as defined to conform when rotated with and to guide the shape of the upper torus-eddy **40*a* of the hot melt being treated. The arrows 36 and 38 shown extending from the discharge openings 36 and 38** of discharge canals represent the pump jets.

The stirrer 10 is rotated relatively rapidly and as a consequence the pumping effect of the inner canal system causes, even when there is a pressure head before the discharge canals 36*a* and 38*a*, vigorous jets to be thrust out from the discharge openings 36 and 38. These jets 28 and 30 rotate with the stirrer and, the said openings 36 and 38 being located a distance below the melt surface act to bring the surrounding melt into rotation as superimposed torus-eddies represented by said force-lines 40*a* and 40*b*. The torus conforming surfaces 34 and 42 being smooth and substantially or predominantly vertically disposed exert only a minimum of frictional contact on the melt, and therefore, rather than transferring substantial power from the stirrer-body 10 to the melt guide effectively the direction of flow and shape of the torus-eddies.

The upwardly angled discharge canals 28 and 30 produce upwardly angled jets 36*a* and 38*a* which impinge upon the upper torus-eddy indicated by force lines 40*a* and cause molten metal that has been pumped from the lower torus eddy (force lines 40*b*) into entrance canal 26 and eventually outward through discharge canals 28 and 30 into admixture, disruptively, with the said upper torus-eddy. Thus any tendency of stratification of molten metal and additives in the melt is minimized by the injection of molten metal, from the lower strata of the melt 14 plus additives introduced within the stirrer 10, into the upper torus eddy (force lines 40*a*) In each particular case, in which viscosity of molten metal and admixed additives may vary, the shape of the torus-conforming surfaces may be chosen with varying relative vertical to horizontal vectors, as best contributes the most efficient torus-eddy desired. In order to keep uniform melt rotation that is, uniform rotating movement of the melt without substantial inner movement of portions of melt body relative to other portions of melt body, to a minimum the stirrer 10 should be rotationally symmetrical and friction between the melt and stirrer body should be minimized and accomplish a lesser rotational vector than that created by molten metal being discharged from the rotating openings of discharge canals 28 and 30. To effect this relationship the stirrer body should be as small as is consistent with its function of mixing additives into, and degassing, the melt, and be substantially free of "paddle-shaped" or horizontal or rectilinear surfaces.

Additional canal 46 within shaft 16 is in communication with bin 24 by means of a flexible rotary coupling 48. Shaft 16 may be provided with a closing means 52 for sealing addition canal 46. Lift 50 may be used to raise and lower closing means 52 and also can rotate closing means 52 as desired. In addition, bin 24 may be pressurized to aid the transfer of material into the melt. The addition canal 46 terminates slightly above the mixing chamber 54 with a partially conical passage 58 having a diameter of $D_6$ at its lower end, the said diameter $D_6$ thus constituting the upper diameter of the mixing chamber 54 and the distance between the upper edges of the defined discharge-canal entrances. Inspection of FIG. 2 will show that the length of diameter $D_6$ must not exceed the length of diameter $D_1$ and in the preferred example illustrated in the said Figure is of about the same length. The addition canal 46 having a diameter $D_5$ is fitted for closing with plug 60.

Figure 3:
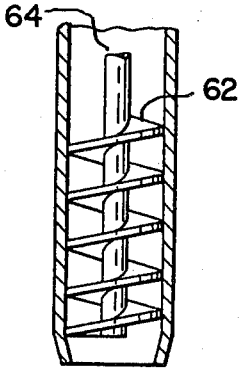
FIG. 3 is a front view parts broken away of an embodiment of the invention using a screw feeder.

The feeding of material to be added through addition canal 46 may be provided by some conventional feeding device. As is shown in FIG. 3, a screw 62 may be fitted with shaft 64 corresponding to closure means 52 to provide a screw feeder driven by unit 50 for feeding particulate material.

As previously discussed the jets produced by the discharge of the melt through the rotating outlets of discharge canals 28 and 30, each outlet having a diameter of $D_4$, bring the melt into rotation causing, in addition to the shaping function of torus-conforming surfaces 34 and 42, superimposed torus-eddies. These eddies homogenize the melt volume rapidly and favorably influence the vertical flow of the added material so that the time of contact between the melt and the added material is prolonged. These desired effects of the torus-eddies are obtained at desired rotational velocities without splashing because of the rotational symmetry of the body. The geometry of the stirrer should therefore contribute to a proper balance between pumping and rotation as will be discussed.

The stirrer of this invention whether used as an injector to add material or a degasser to remove gas dissolved in the melt, produces not only a sufficient melt flow volume but also a correct pressure distribution. In the center of rotation the pressure will be low and in some cases extremely low. This is attributable to not only the stirrer but also the pressure distribution in the melt. Because of the number and complexity of the variables influencing the agitation within the melt a complete mathematical analysis of the system has proved futile. However it is recognized that the discharge rate from the center of the melt rotation and also the flow rate of the melt into the mixing chamber from the entrance canal has a marked effect on the pumping action. The diameter of the entrance canal $D_1$ should not be so small that flow into the mixing chamber is retarded, nor should it be so large as to eliminate the low pressure at the center of melt rotation. Normally, the cross-sectional area of the entrance canal $D_1$ should approximate the total area of the openings $D_4$ in the discharge canals. However, if friction in the entrance canal is very small it may be necessary to reduce $D_1$ to obtain the desired effects.

Preferably the discharge canals 28 and 30 are inclined at least 10° from the horizontal allowing the discharge canals to be curved. Further to increase pumping efficiency the discharge canals may be lengthened or their internal diameter may be reduced from the entrance thereto to the discharge end from $D_3$ to $D_4$ respectively. With such inclination of the pumping canals the ratio of the length between $D_3$ and $D_4$ to the average diameter of the canal can be kept as low as 2:1 while still retaining sufficient melt acceleration.

The efficiency of the stirrer as a pump is further enhanced by a reduction of the cross-sectional area along the discharge canals. Preferably, this reduction of area amounts to 20% from point $D_3$ to the discharge end $D_4$ when the stirrer is rotated once per second and should be increased to 25% when the stirrer is rotated 1.5 times per second.

The cross-section of the canals is normally circular but may be elliptical, while maintaining a normalized area corresponding to the same circular cross-sectional area described. Further, any changes in cross-sectional area of canals from the center of rotation to the discharge openings should be continuous with smooth transitions in case of changes in canal direction.

The shape of the mixing chamber 54 in the center of rotation is critical. The most important feature is that the chamber be relatively large. The area at the end of the discharge canals proximate to the mixing chamber at their lowest parts as defined by area $D_2$ should be at least 40% larger than the cross-sectional area of the entrance canal at $D_1$. The surface $D_2$ is preferably not round. The cross-sectional circle may, for instance, be cut off with extensions parallel to the direction of the discharge canals. The side walls of the mixing chamber, thus shaped, transfer pressure to the melt and acceleration of melt and rotation begins in the center of stirrer rotation. the effective length of the discharge canals, as far as pumping is concerned, then reaches to the center of the mixing chamber and requires to maintain stirrer efficiency, the reduction between the cross-sectional area $D_3$ and $D_4$.

In cases where the rate of rotation is an insufficient means of controlling the melt surface in the mixing chamber, it may be desirable to apply pressure to addition pipe 46. Pressure control along these lines may also be used to control gas release by added material during reaction or mixing with the melt.

When the stirrer is not used for adding materials to the melt the addition pipe may be closed or can be eliminated from the stirrer apparatus. However the conical configuration at $D_6$ is still necessary to allow the gas to collect which is released from the melt.

In clarification of the operation of the stirrer of invention: molten metal that circulates in the torus eddy encircling the upper body of the stirrer will be directed from this circulation by the distortion of the eddy by jets of metal leaving the discharge canals, and this metal will flow to and join the torus eddy which is shaped by and encircles the lower body of the stirrer. The pumping action of the stirrer with preferably two discharge canals will draw molten metal into the entrance canal and into the mixing chamber. The said pumping action further will reduce the pressure in the mixing chamber as molten metal is pumped therefrom into the melt causing a low pressure in the mixing chamber in turn causing the solubility of gas in the metal to drop locally and a degassing to occur in those instances in which the melt contains gas in excess of the equilibrium content at the pressure existing in the said chamber. The gases collect in the upper zone of the mixing chamber formed by the cone shaped entrance of the addition canal and pass upwardly through the addition canal to collection means therefor. Molten metal in the mixing chamber impelled by the stirring action of the stirrer flows through the two discharge canals of diminishing cross-section and jets into the melt in the ladle, thus completing the cycle by which molten metal is treated in the ladle. Additives being introduced in controlled amounts into the melt flow in the mixing chamber and being injected into and homogenized with the body of the melt by means of the so-produced jets constitutes a new and useful contribution to the modern technique of "ladle metallurgy".

What is claimed is:

1. In a vertically symmetrical mechanical stirrer adapted for submersion in a metallurgical melt, for rotation around its vertical axis, and for the mixing of additives throughout the said melt, the said stirrer having a top section operably connected to drive means and a bottom which includes an entrance canal disposed along said vertical axis and has its entrance in the said bottom of the stirrer, and at least two discharge canals in communication with the entrance canal, each canal having an exit feeding into the metallurgical melt, the improved structure comprising:

an upper body of the stirrer constituting the top section that is disposed above the exits of the discharge canals and within which upper body is axially disposed an addition canal in supply communication with the discharge canal, the symmetrical surface of the upper body consisting of a torus conforming surface substantially free of horizontal and rectilinear surfaces; and, eacn said discharge canal being disposed upwardly to its exit at an angle of at least 10° from the horizontal.

2. The stirrer of claim 1 in which a mixing chamber is positioned coaxially beneath said addition canal and is further defined by the community of the entrance canal and the discharge canals.

3. The stirrer of claim 2 in which the said discharge canals are uniformly reduced in internal diameter in the direction of flow from the mixing chamber to their exits into said melt.

4. The stirrer of claim 2 in which the ratio of the length of each discharge canal, measured between the discharge canal entrance and the said exit, to the average inside diameter of the discharge canal is at least 2:1.

5. The stirrer of claim 4 in which the said uniform reduction in internal diameter of the discharge canal is between 20 and 25 percent measured as the resulting reduction in area of the discharge-canal exit compared to that of its entrance.

6. The stirrer of claim 1 in which the upwardly angular disposal of the discharge canal is such that the jet of molten metal flowing from the said canal will interrupt and distort the torour eddy shaped by the said torus conforming surface of the said upper body of the stirrer.

7. The stirrer of claim 1 in which the lower body surface of the stirrer below the exits of the said discharge canals consists of a symmetrical torus-conforming surface of inverted generally bell-shaped conformation, the lower surface thus extending to meet the upper body surface at and about the said exits, thereby shaping a torus eddy disposed beneath the torus eddy shaped by the torus conforming surface of the said upper body.

8. In a vertically symmetrical mechanical stirrer adapted for submersion in a metallurgical melt, for rotation around its vertical axis, and for the mixing of additives throughout the said melt, the said stirrer having an upper body operably connected to drive means and a lower body which includes an entrance canal disposed along said vertical axis and has its entrance therein, at least two discharge canals communicating between the entrance canal and exits into the said melt, and a coaxial addition canal in communication with a mixing chamber, the improved structure comprising:

the said entrance canal having a length that is at most twice its inner diameter; said discharge canals having a length of at least twice their inner diameters; and, said mixing chamber being disposed coaxially beneath the addition canal, the discharge end of which forms the upper portion of the chamber and being in that dimension between the lowest points at the discharge-canal entrances at least twenty percent larger than the inner diameter of the entrance canal;

so that, upon rotation of the stirrer and the pumping of molten metal into the entrance canal, then the mixing chamber, and thereafter through the discharge canals, a zone of reduced pressure is created in the mixing chamber to effect degassing of the molten metal therein.

9. The stirrer of claim 8 in which the said mixing chamber is disposed coaxially beneath the said addition canal so that its hollow frusto-conical terminal forms the uppermost zone of the said chamber and in which the area of a horizontal cross-section of the mixing chamber taken along a line between the said lowest points of the discharge-canal entrances is at least 40 percent larger than the horizontal cross-sectional area of the entrance canal.

10. A vertically symmetrical mechanical stirrer-mixer adapted for submersion in a metallurgical melt contained in a hot-metal ladle, for rotation around its vertical axis, and for the mixing of additives throughout the melt, the said stirrer-mixer having an upper body operably connected to drive means and a lower body which includes an entrance canal disposed along said vertical axis and having its entrance at the bottom of the stirrer-mixer, and at least two discharge canals communicating between the entrance canal and exits into the melt, the improved structure comprising:

a mixing chamber disposed coaxially within the stirrer and defined by the community of the said entrance canal and the discharge canals, and having a length between the lowest points of the discharge-canal entrances at least twenty percent larger than the inner diameter of the entrance canal;

the upper body of the stirrer, disposed above the exit of the discharge canals and within which is axially disposed a closable addition canal in supply communication with an upper portion of the said mixing chamber, the symmetrical surface of the upper body consisting of a torus conforming surface;

the said discharge canals being uniformly reduced in internal diameter in direction of flow from the discharge-canal entrances to their exits into the said melt and being disposed at an angle upwardly to said exits of at least 10° from the horizontal;

the lower body of the stirrer below the exits from the discharge canals consisting of a symmetrical torus-conforming surface of inverted generally bell-shaped conformation, the lower surface thus extending to meet the upper body surface at and about the said exits, the said entrance canal being axially disposed in said lower body, having a length that is at most twice its inner diameter, and being substantially uniform from its entrance to its communication with the mixing chamber, whereby:

a torus eddy developed in the said melt and shaped by the said torus conforming surface of the said upper body is interrupted in its flow so that melt will pass therefrom to a second torus eddy, that is disposed beneath the said first eddy and around the said lower body and is shaped by the said torus-conforming surface of the said lower body, and so that melt will pass from the said second eddy from into the said entrance canal, into a reduced pressure zone in said mixing chamber, and into admixture with melt-treating additives from said addition canal prior to being pumped by the said rotation of the stirrer from the mixing chamber through the discharge canals into the melt.

* * * * *

UNITED STATES PATENT AND TRADEMARK OFFICE

CERTIFICATE OF CORRECTION

PATENT NO. : 4,240,618

DATED : December 23, 1980

INVENTOR(S) : Jan-Erik Ostberg

It is certified that error appears in the above—identified patent and that said Letters Patent is hereby corrected as shown below:

Col. 2, line 8, delete the first occurrence of "and" and substitute therefor --an--;

Col. 2, line 18, delete "285,812" and substitute therefor --2,858,125--;

Col. 3, line 20, delete "entered" and substitute therefor --centered--;

Col. 4, line 11, delete "esp" and substitute therefor --esp--;

Col. 7, line 7, delete the first occurrence of "the" and substitute therefor --The--;

Col. 8, line 6, delete "eacn" and substitute therefor --each--; and

Col. 8, line 29, delete "torour" and substitute therefor --torous--.

Signed and Sealed this

*Thirtieth* Day of *June 1981*

[SEAL]

*Attest:*

RENE D. TEGTMEYER

*Attesting Officer* *Acting Commissioner of Patents and Trademarks*